US009763552B2

(12) United States Patent
Chapman et al.

(10) Patent No.: US 9,763,552 B2
(45) Date of Patent: Sep. 19, 2017

(54) DISHWASHER DIVERTER VALVES WITH CONTINUOUS CALIBRATION

(71) Applicant: General Electric Company, Schenectady, NY (US)

(72) Inventors: John Gilman Chapman, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 499 days.

(21) Appl. No.: 14/303,012

(22) Filed: Jun. 12, 2014

(65) Prior Publication Data

US 2015/0359410 A1 Dec. 17, 2015

(51) Int. Cl.
*A47L 15/42* (2006.01)

(52) U.S. Cl.
CPC ..... *A47L 15/4221* (2013.01); *A47L 2401/07* (2013.01); *A47L 2401/20* (2013.01); *A47L 2501/03* (2013.01); *A47L 2501/26* (2013.01)

(58) Field of Classification Search
None
See application file for complete search history.

(56) References Cited

U.S. PATENT DOCUMENTS 7,819,983 B2 10/2010 Kim et al.
2008/0011341 A1 1/2008 Kim et al.
2011/0120500 A1 5/2011 Heisele et al.
2011/0126863 A1 6/2011 Kränzle et al.
2015/0286222 A1* 10/2015 Goldstein ..... G05D 7/0635 700/282
2015/0316936 A1* 11/2015 McCarrick ..... G05D 7/0676 700/282

FOREIGN PATENT DOCUMENTS

JP 2005124979 5/2005

OTHER PUBLICATIONS

JP Patent Pub No. 2005124979 translation.*

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

Diverter valves and associated dishwashers with continuous calibration are provided. An example dishwasher includes a diverter valve assembly. The diverter valve assembly is configured to output a signal having a plurality of pulses. Each of the plurality of pulses has an activation time indicative of movement of the diverter valve assembly into one of a plurality of positions. The dishwasher performs operations including receiving the signal from the diverter valve assembly and determining a current activation time associated with the most recent pulse exhibited by the signal. The operations include determining a current position of the plurality of positions based at least in part on the current activation time and a plurality of average activation times respectively associated with the plurality of positions. The operations include, after determining the current position, updating the average activation time associated with the current position based at least in part on the current activation time.

11 Claims, 6 Drawing Sheets

DISHWASHER DIVERTER VALVES WITH CONTINUOUS CALIBRATION

FIELD OF THE INVENTION

The present disclosure relates generally to dishwashers with diverter valves. In particular, the present disclosure relates to systems and methods for continuously calibrating diverter valve positioning assessments.

BACKGROUND OF THE INVENTION

Dishwashers of various types have been proposed wherein items are placed in a wash chamber which is filled and emptied according to desired wash sequences. Recently, dishwasher manufacturers have focused even more on efficiency in implementing new designs. Thus, an amount of electricity, an amount of detergent, and an amount of water used are all monitored or otherwise attempted to be reduced in an attempt to provide efficient and environmentally sensitive machines.

Many dishwashers have more than one outlet within them for spraying water within the wash chamber. For example, dishwashers typically have an upper rack and a lower dish rack. Such dishwashers may have a multiple rotating spray arms located at a lower level, a midlevel (between dish racks), and an upper level that spray during a wash or rinse cycle. Some dishwashers have two such sprayers and some have more.

To reduce the amount of water used in such multiple sprayer dishwashers, it can be desirable to alternate spraying between the multiple spray arm assemblies. Doing so requires a smaller amount of water in the wash chamber because only half of the spray system need be actively filled with water at a time.

One way in which such alternate spraying schemes are achieved is through the use of a diverter valve. For example, the diverter valve can be a valve device that can be placed into multiple positions or configurations. Each position can direct the flow of water according to a different pattern or destination(s). Therefore, by controlling or otherwise operating the diverter valve, the dishwasher can switch between various spray schemes or other desired water flow patterns.

Thus, knowledge of the current position of the diverter valve and the ability to place the diverter valve into a desired position is typically required for proper diverter valve operation and control. For example, certain control variables may be stored in a non-volatile memory and used by a microprocessor control device when controlling the diverter valve.

However, over time, wear and tear on a system can alter the operating parameters or part performance of the diverter valve. As examples, a motor that rotates the diverter valve between positions may become less effective over time, rotating diverter parts may suffer from increased friction over time as lubricants are lost or parts become worn, or replacement parts may be introduced into the diverter valve assembly or associated components. When such operating parameters are altered, use of pre-set control variables can impair the ability of the dishwasher to successfully place the diverter valve into a desired position.

Therefore, diverter valves and associated dishwashers that provide continuous calibration over the lifespan of the diverter valve are desirable.

BRIEF DESCRIPTION OF THE INVENTION

Aspects and advantages of the invention will be set forth in part in the following description, or may be obvious from the description, or may be learned through practice of the invention.

One aspect of the present disclosure is directed to a dishwasher. The dishwasher includes a diverter valve assembly. The diverter valve assembly is configured to output a signal having a plurality of pulses. Each of the plurality of pulses has an activation time indicative of movement of the diverter valve assembly into one of a plurality of positions respectively corresponding to a plurality of patterns of liquid flow in the dishwasher. The dishwasher includes one or more processing devices. The dishwasher includes a non-transitory computer-readable medium storing instructions that, when executed by the one or more processing devices, cause the one or more processing devices to perform operations. The operations include receiving the signal from the diverter valve assembly. The operations include determining a current activation time associated with the most recent pulse exhibited by the signal. The operations include determining a current position of the plurality of positions based at least in part on the current activation time and a plurality of average activation times respectively associated with the plurality of positions. The operations include, after determining the current position, updating the average activation time associated with the current position based at least in part on the current activation time.

Another aspect of the present disclosure is directed to a dishwasher. The dishwasher includes a diverter valve assembly. The diverter valve assembly includes a diverter valve. The diverter valve can be oriented in a plurality of positions respectively corresponding to a plurality of patterns of liquid flow in the dishwasher. The diverter valve assembly includes a cam rotatably mounted within the diverter valve assembly. The cam has a plurality of protrusions along an outer edge of the cam. The plurality of protrusions have a plurality of different angular lengths. Each of the plurality of protrusions has a rising edge and a falling edge. The falling edge of each of the plurality of protrusions is located at a first point in a rotational path of the outer edge of the cam when the diverter valve is oriented in a respective one of the plurality of positions. The diverter valve assembly includes a protrusion sensor configured to provide an output signal indicative of the presence or absence of one of the plurality of protrusions at the first point in the rotational path. The dishwasher includes a controller configured to control the diverter valve based at least in part on a plurality of activation times exhibited by the output signal of the protrusion sensor and a plurality of average activation times respectively associated with the plurality of positions. Each of the plurality of activation times exhibited by the output signal is a length of time for which the output signal of the protrusion sensor continuously indicates that one of the plurality of protrusions is present at the first point in the rotational path. The controller updates the plurality of average activation times respectively associated with the plurality of positions based on the plurality of activation times exhibited by the output signal.

Another aspect of the present disclosure is directed to a method for controlling a diverter valve in a dishwasher. The diverter valve is capable of orientation in a plurality of positions respectively corresponding to a plurality of patterns of liquid flow in the dishwasher. The method includes receiving, by one or more processing devices, an output signal from a protrusion sensor. The output signal is indicative of the presence or absence of one of a plurality of protrusions of a cam of the diverter valve at a first point in a rotational path of an outer edge of the cam of the diverter valve. The method includes determining, by the one or more processing devices, a current activation time exhibited by the output signal. The current activation time is a length of time for which the output signal most recently indicated the presence of one of the plurality of protrusions at the first point. The method includes determining, by the one or more processing devices, a current position of the diverter valve by comparing the current activation time to one or more threshold times respectively associated with each of the plurality of positions. The method includes updating, by the one or more processing devices, the one or more threshold times associated with the current position based at least in part on the current activation time.

These and other features, aspects and advantages of the present invention will be better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
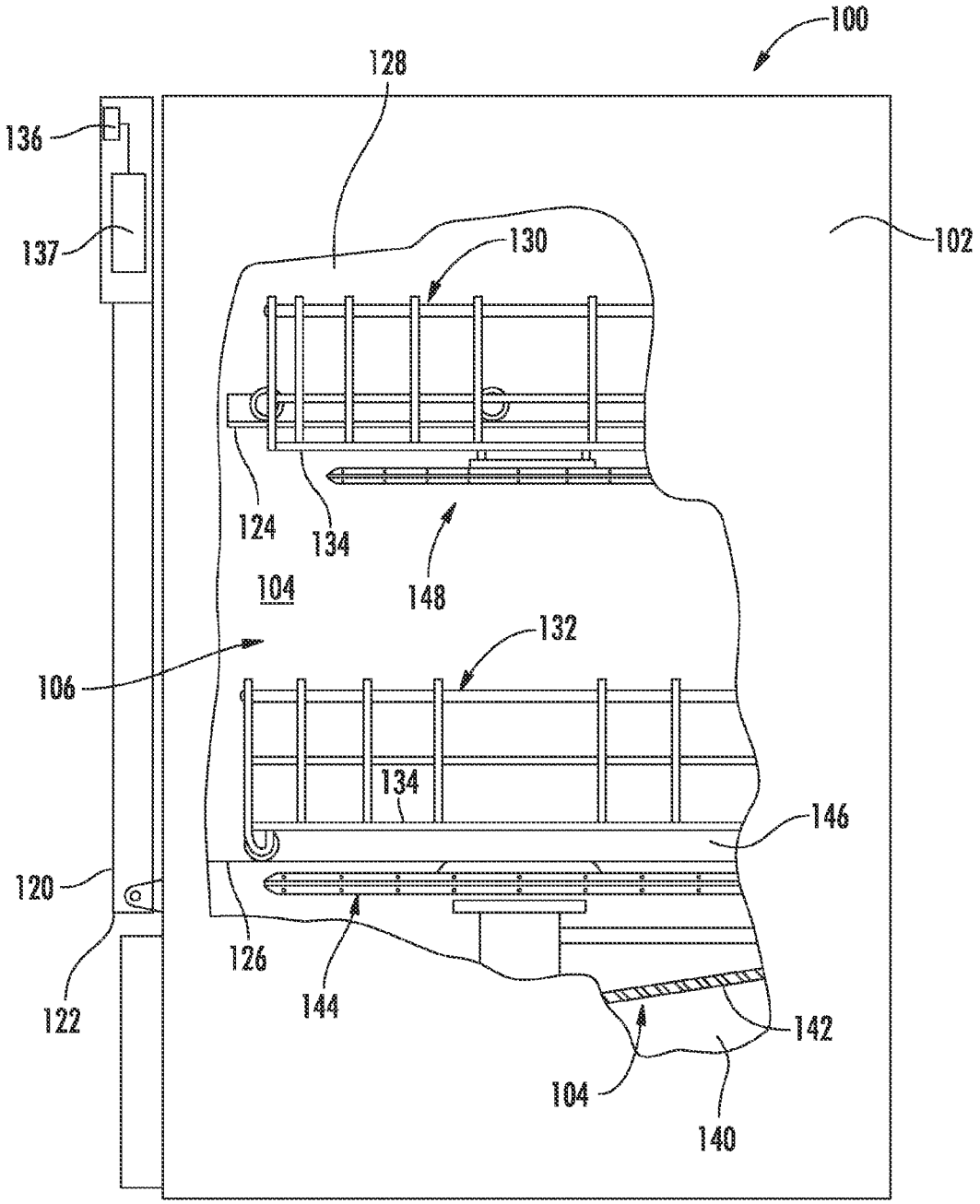
FIG. 1 provides a side partial cut-away view of an example dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an example domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller 137 may include a memory and one or more processing devices, such as a general or special purpose microprocessor operable to execute programming instructions or micro-control code associated with various operations. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area of door 120 as shown. In such an embodiment, input/output ("I/O") signals may be routed between the control system and various operational components of dishwasher 100 along wiring harnesses that may be routed through the bottom 122 of door 120. The controller 137 can include a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles.

Figure 2:
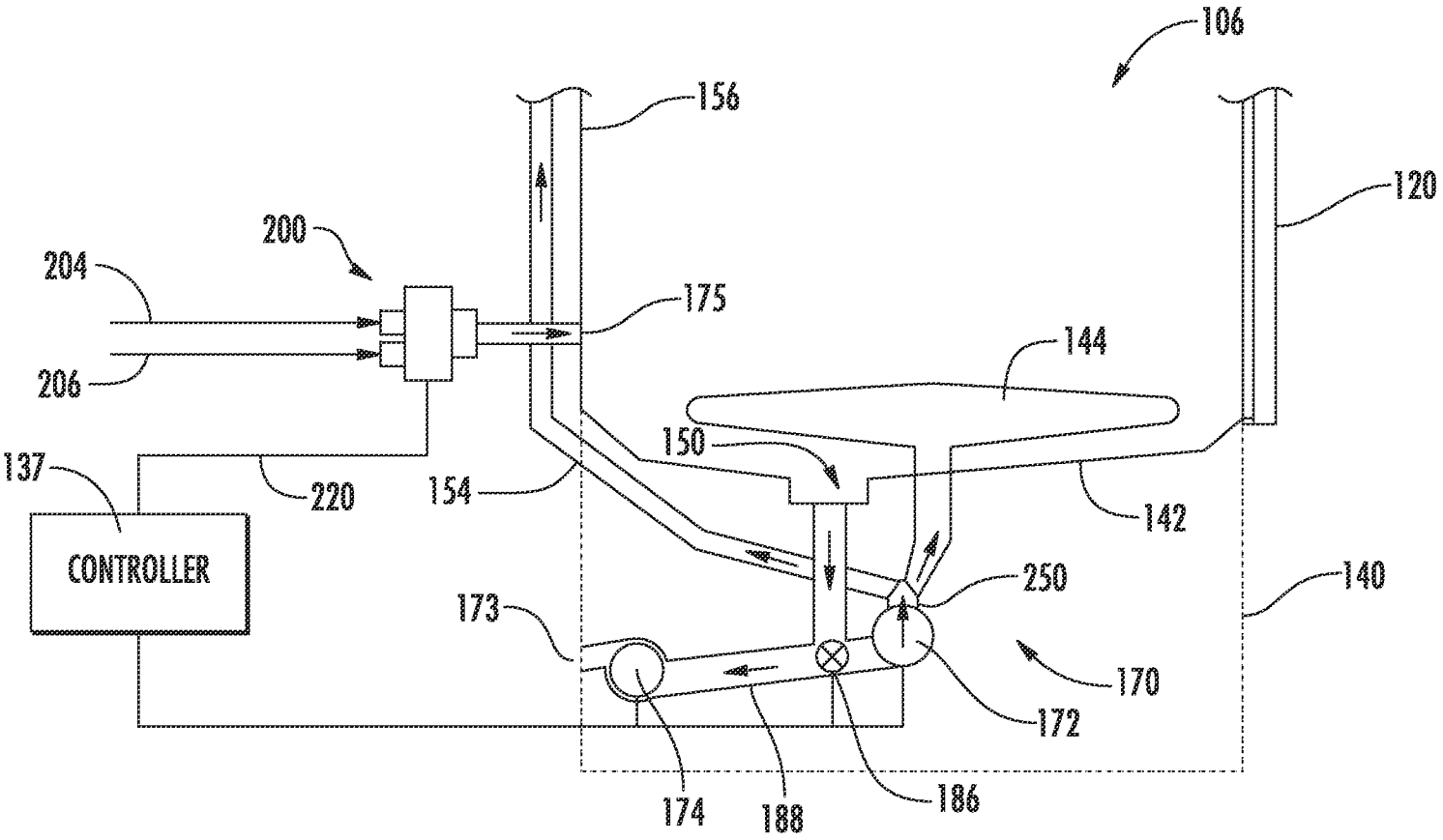
FIG. 2 is a schematic view of one possible fluid system the dishwasher of FIG. 1.

FIG. 2 schematically illustrates an embodiment of a fluid circulation assembly 170 configured below the wash chamber 106. Although one embodiment of a fluid circulation assembly that is operable to perform in accordance with aspects of the disclosure is shown, it is contemplated that many other fluid circulation assembly configurations may similarly be utilized without departing from the spirit and scope of the present disclosure. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 of wash chamber 106, and upward along the back wall 156 for feeding wash liquid to the mid-level spray arm assembly 148 (FIG. 1) and the upper spray arm assembly.

A diverter valve assembly 250 can be located between circulation pump assembly output and the conduits to the different spray arm assemblies 144 and 148 and can be operated to divert flow one way or the other. As an example, the diverter valve assembly can have four positions that respectively result in liquid flow to the spray arm assembly 144; spray arm assembly 148; both of spray arm assemblies 144 and 148; or neither of spray arm assemblies 144 and 148. This configuration also applies to a drawer-type of dishwasher, as mentioned above. Furthermore, diverter valves in accordance with the present disclosure can be used at various other locations in the dishwasher at which control of water flow between various available flow patterns is desirable.

As wash liquid is pumped through either the lower spray arm assembly 144 or the mid-level spray arm assembly 148 and the upper spray arm assembly (not shown), washing sprays are generated in the wash chamber 106, and wash liquid collects in the sump 150. The sump 150 may include a cover to prevent larger objects from entering the sump 150, such as a piece of silverware or another dishwasher item that is dropped beneath lower rack 132. A coarse filter and a fine filter (not shown) may be located adjacent the sump 150 to filter wash liquid for sediment and particles of predetermined sizes before flowing into the sump 150. Furthermore, a turbidity sensor may be coupled to the sump 150 and used to sense a level of sediment in the sump 150 and to initiate a sump purge cycle where the contents or a fractional volume of the contents of the sump 150 are discharged when a turbidity level in the sump 150 approaches a predetermined threshold. The sump 150 is filled with water through an inlet port 175 which outlets into wash chamber 106.

As shown, a drain valve 186 is established in flow communication with the sump 150 and opens or closes flow communication between the sump 150 and a drain pump inlet 188. The drain pump assembly 174 is in flow communication with the drain pump inlet 188 and may include an electric motor for pumping fluid at the inlet 188 to an external drain system via drain 173. In one embodiment, when the drain pump is energized, a negative pressure is created in the drain pump inlet 188 and the drain valve 186 is opened, allowing fluid in the sump 150 to flow into the fluid pump inlet 188 and be discharged from fluid circulation assembly 170 via the external drain 173. Alternatively, pump assemblies 172 and 174 may be connected directly to the side or the bottom of sump 150, and the pump assemblies may each include their own valving replacing drain valve 186. Other fluid circulation systems are possible as well, drawings fluid from sump 150 and providing as desired within wash chamber 106 or draining out of washing machine 100.

A water supply 200 may be configured with the inlet port 175 for supplying wash liquid to the wash chamber 106. The water supply 200 may provide hot water only, cold water only, or either selectively as desired. As depicted, water supply 200 has a hot water inlet 204 that receives hot water from an external source, such as a hot water heater and a cold water input 206 that receives cold water from an external source. It should be understood that the term "water supply" is used herein to encompass any manner or combination of valves, lines or tubing, housing, and the like, and may simply comprise a conventional hot or cold water connection.

Figure 3:
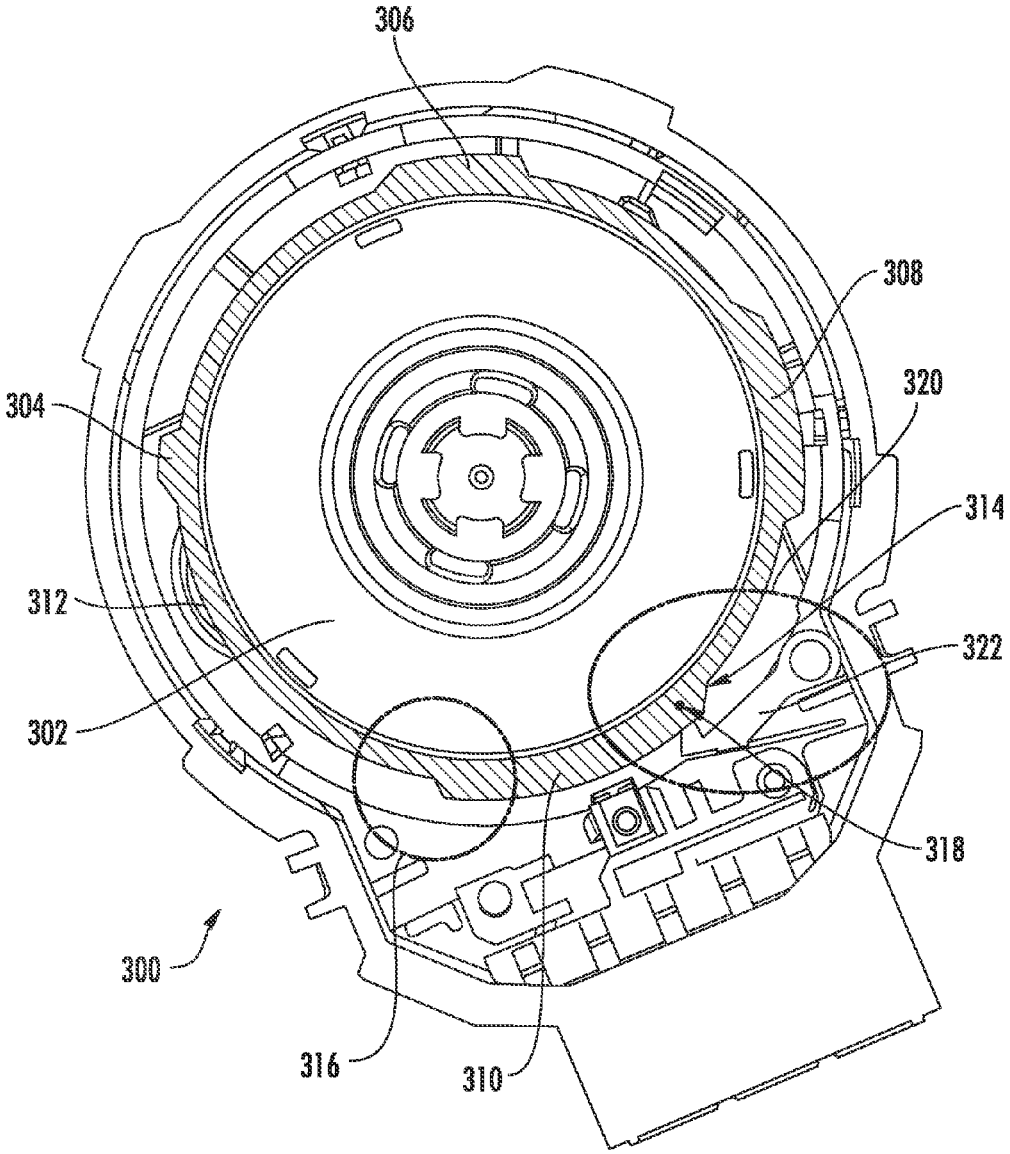
FIG. 3 depicts an example diverter valve assembly according to an example embodiment of the present disclosure.

FIG. 3 depicts an example diverter valve assembly 300 according to an example embodiment of the present disclosure. Diverter valve assembly 300 can include a cam 302. The cam 302 can be rotatably mounted within the diverter valve assembly 300. The cam 300 can include a plurality of protrusions along an outer edge 312 of the cam 302. For example, cam 302 includes protrusions 304, 306, 308, and 310.

As shown in FIG. 3, each of protrusions 304, 306, 308, and 310 can have a different angular length. Further, each of protrusions 304, 306, 308, and 310 can have a rising edge and a falling edge. For example, in the event that the cam 302 rotates in a counter-clockwise position from the perspective shown in FIG. 3, protrusion 310 will have a rising edge 314 and a falling edge 316.

According to an aspect of the present disclosure, the falling edge of each of protrusions 304, 306, 308, and 310 will be located at a first point 318 in the rotational path of the outer edge 312 of cam 302 when the diverter valve of diverter valve assembly 300 is oriented in a respective one of a plurality of available positions respectively corresponding to a plurality of patterns of liquid flow. More particularly, cam 302 can be configured so that its position is representative of the position of the diverter valve. Thus, as the diverter valve is moved into a particular one of a plurality of positions, the cam will rotate such that the falling edge of one of protrusions 304, 306, 308, and 310 is located at first point 318 when the diverter valve reaches the particular position. Therefore, in some embodiments, the number of protrusions included in cam 302 will be equivalent to the number of particular positions into which the diverter valve can be placed.

As an example, the diverter valve can be rotatable into the plurality of positions. For example, a motor can be used to rotate the diverter valve into the plurality of positions. In some of such embodiments, the cam 302 be secured with respect to the diverter valve such that the cam 302 rotates concurrently with the diverter valve. For example, the cam 302 can share a shaft structure or shaft axis with the diverter valve. As another example, the diverter valve assembly 300 can include gearing that causes the cam 302 to rotate when the diverter valve is rotated or otherwise manipulated.

According to another aspect of the present disclosure, the diverter valve assembly 300 can include a protrusion sensor 320. The protrusion sensor 320 can provide an output signal indicative of the present or absence of one of the plurality of protrusions at the first point 318 in the rotational path of the outer edge 312 of cam 302.

As an example, as shown in FIG. 3, the protrusion sensor 320 can include a mechanical arm 322 that is biased towards a first orientation. The output signal of the protrusion sensor 320 can have a first value (e.g. a "low" voltage that is approximately zero volts) when the arm is in the first orientation. The arm 322 can be pushed into a second orientation when one of the plurality of protrusions is present at the first point 318. For example, as shown in FIG. 3, the arm 322 has been pushed into the second orientation by protrusion 310. The output signal of the protrusion sensor 320 can have a second value (e.g. a "high" voltage that is approximately five or some other non-zero number of volts).

It should be appreciated, that the "low" and "high" voltages can be any suitable values. Further, the protrusion sensor 320 can have an alternate configuration such that the "low" and "high" voltages are interchanged; that is, the output signal can be inverted from the signal described above. In addition, the design of protrusion sensor 320 depicted in FIG. 3 is provided as an example only. The protrusion sensor 320 can have any suitable design that provides an output signal indicative of the presence or absence of a protrusion of cam 302 at first point 318.

In an example operation of diverter valve assembly 300, cam 302 is rotated in accordance with movement of the diverter valve from one position to another. The protrusion sensor 320 may be at the first orientation and, therefore, the output signal will exhibit a low value. As the diverter valve approaches the next position, the rising edge of a corresponding protrusion of cam 302 will force the arm 322 into the second orientation and, therefore, the output signal will exhibit the high value. Once the diverter valve reaches the next position, the falling edge of the corresponding protrusion will reach the first point 318 and, therefore, allow the arm 322 to return to the first position and return the output signal to the low value. Therefore, transition of the output signal from the high value to the low value can indicate that the diverter valve has reached a particular position.

As such, when the diverter valve is manipulated to reach several positions, the output signal will exhibit a plurality of pulses (e.g. sections of the high value). Each of the plurality of pulses will have an activation time. In particular, the activation time of a pulse will be the length of time for which the pulse exists (e.g. the length of time for which the output signal indicates the presence of the protrusion). Because the protrusions of cam 302 have different angular lengths, the activation times of the pulses can be indicative of the relative position of the cam and, correspondingly, the diverter valve. Thus, a controller can control the diverter valve by using the activation times as feedback for diverter valve positioning assessments.

Furthermore, according to an aspect of the present disclosure, the activation times exhibited by the pulses of the output signal can vary or drift over time as parts become worn or replaced. Therefore, the dishwashers of the present disclosure can provide continuous calibration over the lifetime of the dishwasher. For example, method (500), discussed further below, is an example method for providing continuous calibration of the diverter valve assembly 300 of FIG. 3.

Figure 4:
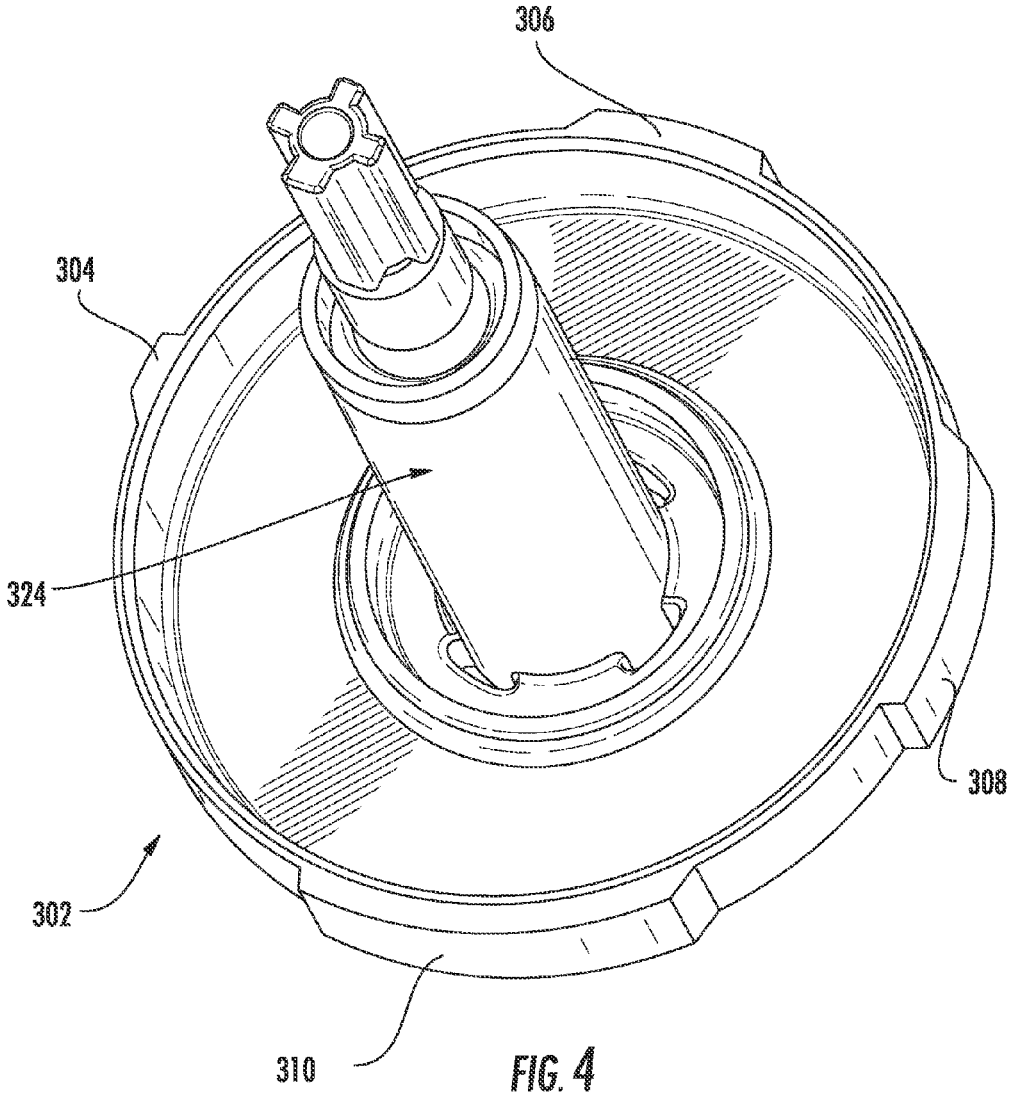
FIG. 4 depicts an example diverter valve cam according to an example embodiment of the present disclosure.

FIG. 4 depicts example diverter valve cam 302 according to an example embodiment of the present disclosure. In particular, FIG. 4 depicts the underside of the diverter valve cam 302. The protrusions 304, 306, 308, and 310 are shown. Also shown is a shaft 324 of the cam 302 that can be rotated so as the rotate cam 302. In some embodiments, the shaft 324 can be secured to or otherwise integrated with a rotating shaft of the diverter valve.

Figure 5A:
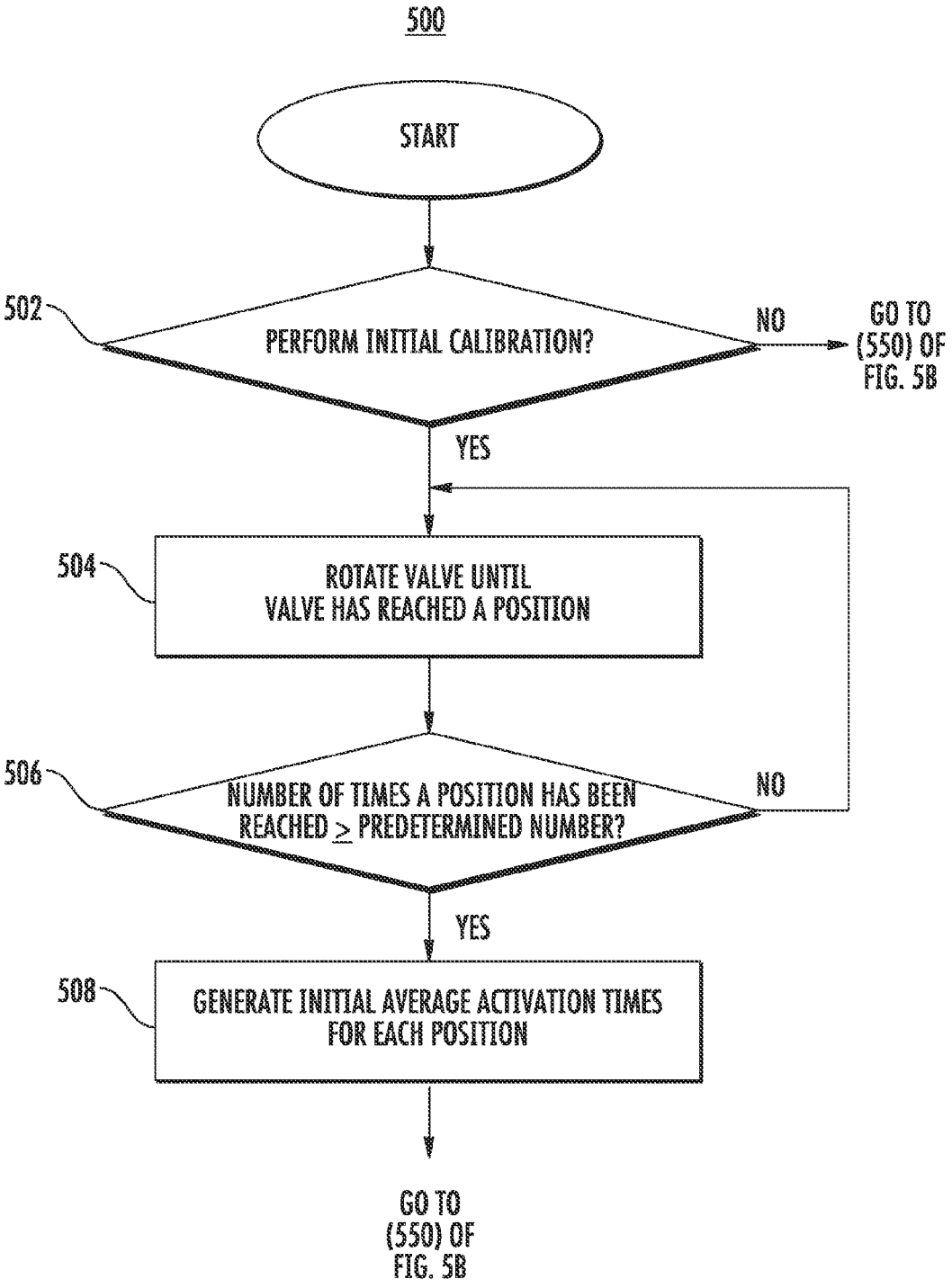
FIGS. 5A and 5B depict a flow chart of an example method for controlling a diverter valve according to an example embodiment of the present disclosure.
Figure 5B:
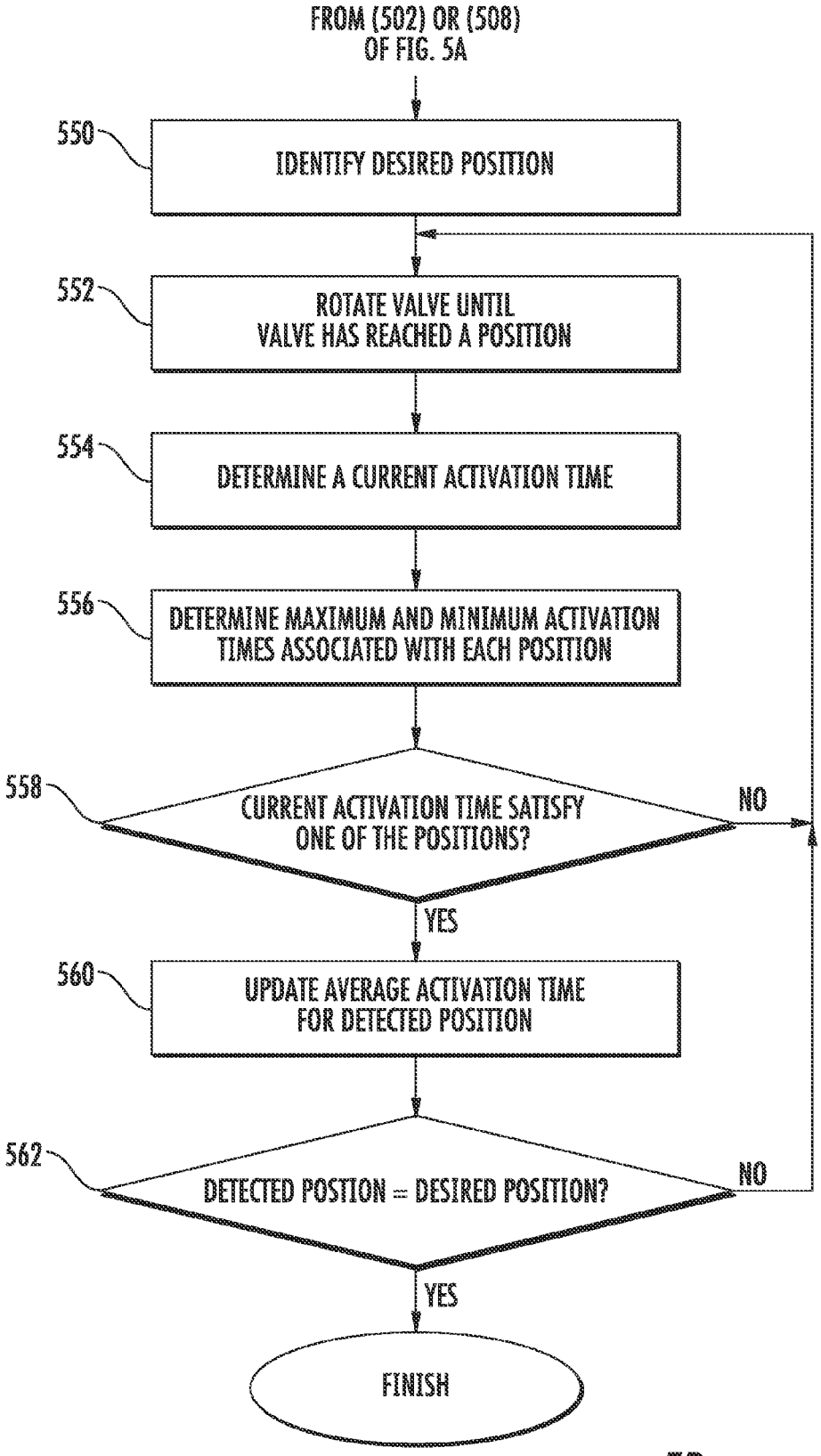

FIGS. 5A and 5B depict a flow chart of an example method (500) for controlling a diverter valve according to an example embodiment of the present disclosure. Method (500) can be implemented by any suitable dishwashing system.

In addition, FIGS. 5A and 5B depict steps performed in a particular order for purposes of illustration and discussion. Those of ordinary skill in the art, using the disclosures provided herein, will understand that the various steps of method (500) can be omitted, adapted, performed simultaneously, and/or rearranged in various ways without departing from the scope of the present disclosure.

Referring to FIG. 5A, at (502) it can be determined whether an initial calibration should be performed. For example, the dishwasher can configured to perform an initial calibration routine upon each instance of powering up, periodically at certain times, after or prior to certain operations, and/or upon a very first initialization (e.g. after home installation). Thus, at (502) it can be determined whether one of those scenarios is satisfied and, therefore, an initial calibration routine should be performed.

If it is determined at (502) that an initial calibration should not be performed, then method (500) can proceed to (550) of FIG. 5B. However, if it is determined at (502) that an initial calibration should be performed, then method (500) can proceed to (504) of FIG. 5A.

At (504) the diverter valve can be rotated until the diverter valve has reached one of a plurality of available positions. For example, the dishwasher can operate a motor to rotate the diverter valve. As discussed above, a transition from one output signal value to another (e.g. high to low) can indicate that the falling edge of a protrusion has reached a certain point along the rotational path of the cam and, therefore, the diverter valve has reached one of the plurality of available positions. Thus, at (504) the diverter valve can be rotated until such a transition is observed.

At (506) it can be determined whether a number of times the diverter valve has reached a position is greater than or equal to a predetermined number. For example, during the calibration routine the diverter valve can be cycled through each of the available positions to obtain samples of the corresponding activation times. Thus, in some embodiments, the predetermined number can be equivalent to the number of available positions (e.g. four). In other embodiments, the predetermined number can be equivalent to an integer number times the number of available positions such that the integer number of activation time samples are obtained for each position. In alternative embodiments, the diverter valve may be continuously rotated until the predetermined number of transitions have been observed.

If it is determined at (506) that the number of times a position has been reached is not greater than or equal to the predetermined number, then method (500) can return to (504) and again rotate the diverter valve until the diverter valve has reached a position.

However, if it is determined at (506) that the number of times a position has been reached is greater than or equal to the predetermined number, then method (500) can proceed to (508).

At (508) an initial average activation time can be generated or otherwise determined for each of the plurality of positions. As an example, at (508) the activation times exhibited by the pulses of the output signal during rotation of the diverter valve can be determined. For example, if the diverter valve was rotated through four positions, then four most recent activation times exhibited by the output signal can be determined.

As another example, at (508) the activation times exhibited by the output signal during the calibration rotations can be sorted into a sequence according to magnitude (e.g. lowest to highest). The activation times can then be assigned to respective positions according to the sequence. Sorting the activation times allows the calibration routine can begin with the diverter valve placed according to any position.

The activation times observed during the calibration rotations performed can be used to respectively compute and save the initial average activation times for the plurality of positions at (508). After (508), method (500) can proceed to (550) of FIG. 5B.

Referring now to FIG. 5B, at (550) a desired position can be identified. For example, the dishwasher may desire to perform one or more specific operations (e.g. pump water to both an upper and lower spray arm). The operations may require that the diverter valve be moved into a specific, desired position. Thus, at (550) such desired position can be identified.

At (552) the diverter valve can be rotated until the diverter valve has reached one of a plurality of available positions. For example, as discussed above, the diverter valve can be rotated until the output signal exhibits a particular transition from one output signal value to another (e.g. high to low).

At (554) a current activation time can be determined. For example, the activation time associated with the most recent pulse exhibited by the output signal can be determined. This length of time can be used as the current activation time.

At (556) a maximum and a minimum activation time can be determined for each of the plurality of positions. In particular, the maximum and minimum activation time for each of the plurality of positions can be determined based on the average activation time associated with such position. The maximum and minimum activation times can be used as threshold to sort or otherwise classify the current activation time.

As an example, the maximum activation time for each of the plurality of positions can be the average activation time for such position multiplied by a first number that is greater than one (e.g. 1.5 or 150%). Likewise, the minimum activation time for each of the plurality of positions can be the average activation time for such position multiplied by a second number that is less than one (e.g. 0.5 or 50%).

As another example, the maximum activation time for each of the plurality of positions can be a first midpoint between the average activation time for such position and the next greatest average activation time associated with one of the plurality of positions. Thus, if the average activation time for a particular position is 3 seconds and the next greatest average activation time is 4 seconds, then the maximum average activation time for the particular position can be 3.5 seconds. Likewise, the minimum activation time for each of the plurality of positions can be a second midpoint between the average activation time for such position and the next least average activation time associated with one of the plurality of positions. Many other ways of calculating maximum and minimum activation times can be used as well.

At (558) it can be determined whether the current activation time satisfies or can otherwise be classified as corresponding to one of the plurality of positions. For example, if the current activation time resides between the minimum and maximum activation times for a given position, then such position can be detected as the current position of the diverter valve. In other embodiments, the position having the average activation time that is closest to the current activation time can be selected as the current position of the diverter valve.

If it is determined at (558) that the current activation time does not satisfy one of the plurality of positions, then method (500) can return to (552) and again rotate the diverter valve until the diverter valve has reached a position. However, if it is determined at (558) that the current activation time does satisfy one of the plurality of positions, then method (500) can proceed to (560).

At (560) the average activation time associated with the detected position can be updated using the current activation time. As an example, updating the average activation time associated with the current position at (560) can include entering the average activation time and the current activation time into a weighted average formula to calculate an updated average activation time for the current position. For example, the updated average activation time can be equal to the current activation time times twenty percent plus the former average activation time times eighty percent. Other weightings can be used as well and can change over the life of the dishwasher.

Updating the average activation times in such fashion can compensate for changes in system operating parameters. Furthermore, it should be appreciated that many different formulations can be used to calculate an updated average based on the new data (e.g. the current activation time). For example, a moving window average can be used.

At (562) it can be determined whether the detected position is the desired position. If it is determined at (562) that the detected position is not the desired position then method (500) can return to (552) and again rotate the diverter valve until the diverter valve has reached a position. However, if it is determined at (562) that the detected position is the desired position then method (500) can finish.

In such fashion, the average activation times respectively associated with the plurality of diverter valve positions can be continuously calibrated over the lifetime of the dishwasher, thereby compensating for worn or replaced parts.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher comprising:

a tub;

a cabinet;

a wash chamber;

one or more racks;

a diverter valve assembly, wherein the diverter valve assembly is configured to output a signal having a plurality of pulses, each of the plurality of pulses having an activation time, the activation time of each of the plurality of pulses being the length of time for which each of the plurality of pulses exist, the activation time being indicative of movement of the diverter valve assembly into one of a plurality of positions respectively corresponding to a plurality of patterns of liquid flow in the dishwasher;

one or more processing devices; and a non-transitory computer-readable medium storing instructions that, when executed by the one or more processing devices, cause the one or more processing devices to perform operations, the operations comprising:

receiving the signal from the diverter valve assembly;

determining a current activation time associated with the most recent pulse exhibited by the signal;

determining a current position of the plurality of positions based at least in part on the current activation time and a plurality of average activation times respectively associated with the plurality of positions;

after determining the current position, updating the average activation time associated with the current position based at least in part on the current activation time; and operating the diverter valve assembly based on the activation time to achieve continuous calibration of the diverter valve assembly.

2. The dishwasher of claim 1, wherein determining the current position of the plurality of positions based at least in part on the current activation time and the plurality of average activation times respectively associated with the plurality of positions comprises:

determining one or more threshold times for each of the plurality of positions based at least in part on the average activation time associated with such position.

3. The dishwasher of claim 2, wherein determining the one or more threshold times for each of the plurality of positions based at least in part on the average activation time associated with such position comprises:

determining a maximum activation time and a minimum activation time for each of the plurality of positions based at least in part on the average activation time associated with such position.

4. The dishwasher of claim 3, wherein:

the maximum activation time for each of the plurality of positions comprises the average activation time for such position multiplied by a first number that is greater than one; and the minimum activation time for each of the plurality of positions comprises the average activation time for such position multiplied by a second number that is less than one.

5. The dishwasher of claim 3, wherein:

the maximum activation time for each of the plurality of positions comprises a first midpoint between the average activation time for such position and a next greatest average activation time associated with one of the plurality of positions; and the minimum activation time for each of the plurality of positions comprises a second midpoint between the average activation time for such position and a next least average activation time associated with one of the plurality of positions.

6. The dishwasher of claim 3, wherein determining the current position of the plurality of positions based at least in part on the current activation time and the plurality of average activation times respectively associated with the plurality of positions further comprises:

classifying the current position as the position for which the current activation time is between the maximum activation time and the minimum activation time.

7. The dishwasher of claim 1, wherein updating the average activation time associated with the current position based at least in part on the current activation time comprises:

entering the average activation time and the current activation time into a weighted average formula to calculate an updated average activation time for the current position.

8. The dishwasher of claim 1, wherein the operations further comprise performing a calibration routine to obtain the plurality of average activation times respectively associated with the plurality of positions.

9. The dishwasher of claim 8, wherein the calibration routine comprises:

cycling the diverter valve assembly through each of the plurality of positions;

determining a plurality of initial activation times exhibited by the signal when the diverter valve is respectively cycled through the plurality of positions; and determining the plurality of average activation times respectively associated with the plurality of positions based on the plurality of initial activation times.

10. The dishwasher of claim 9, wherein determining the plurality of initial activation times exhibited by the signal when the diverter valve is respectively cycled through the plurality of positions comprises:

sorting the plurality of initial activation times into a sequence by magnitude; and respectively assigning the plurality of initial activation times to the plurality of positions based on the sequence.

11. The dishwasher of claim 1, wherein the dishwasher valve assembly comprises:

a diverter valve, wherein the diverter valve can be oriented in the plurality of positions respectively corresponding to the plurality of patterns of liquid flow in the dishwasher;

a cam rotatably mounted within the diverter valve assembly, wherein the cam has a plurality of protrusions along an outer edge of the cam, the plurality of protrusions having a plurality of different angular lengths, each of the plurality of protrusions having a rising edge and a falling edge, and wherein the falling edge of each of the plurality of protrusions is located at a first point in a rotational path of the outer edge of the cam when the diverter valve is oriented in a respective one of the plurality of positions; and a protrusion sensor configured to output the signal having the plurality of pulses, each of the plurality of pulses being indicative of the presence of one of the plurality of protrusions at the first point in the rotational path.

* * * * *